US010616689B2

(12) United States Patent
Yamada et al.

(10) Patent No.: US 10,616,689 B2
(45) Date of Patent: Apr. 7, 2020

(54) PIEZOELECTRIC SOUNDING COMPONENT

(71) Applicant: Murata Manufacturing Co., Ltd., Nagaokakyo-shi, Kyoto-fu (JP)

(72) Inventors: Kazuchika Yamada, Nagaokakyo (JP); Masakazu Yamauchi, Nagaokakyo (JP); Yuko Yokoi, Nagaokakyo (JP)

(73) Assignee: MURATA MANUFACTURING CO., LTD., Nagaokayo-Shi, Kyoto-Fu (JP)

( * ) Notice: Subject to any disclaimer, the term of this patent is extended or adjusted under 35 U.S.C. 154(b) by 0 days.

(21) Appl. No.: 15/983,433

(22) Filed: May 18, 2018

(65) Prior Publication Data

US 2018/0270585 A1 Sep. 20, 2018

Related U.S. Application Data

(63) Continuation of application No. PCT/JP2017/019020, filed on May 22, 2017.

(30) Foreign Application Priority Data

Sep. 28, 2016 (JP) ..... 2016-189737

(51) Int. Cl.
*H04R 17/00* (2006.01)
*H04R 31/00* (2006.01)
(Continued)

(52) U.S. Cl.
CPC ..... *H04R 17/00* (2013.01); *B06B 1/0651* (2013.01); *G10K 9/122* (2013.01); *G10K 9/22* (2013.01);
(Continued)

(58) Field of Classification Search
CPC ..... H04R 17/00; H04R 31/003; H04R 1/06; H01L 41/083; H01L 41/0973; B06B 1/0603
(Continued)

(56) References Cited

U.S. PATENT DOCUMENTS 6,445,108 B1 * 9/2002 Takeshima ..... B06B 1/0603 310/322
6,570,299 B2 * 5/2003 Takeshima ..... H04R 17/00 29/25.35
(Continued)

FOREIGN PATENT DOCUMENTS

JP 2004015767 A 1/2004
WO 2007097077 A1 8/2007
(Continued)

OTHER PUBLICATIONS

International Search Report issued for PCT/JP2017/019020, dated Jul. 4, 2017.
(Continued)

*Primary Examiner* — Fan S Tsang
*Assistant Examiner* — Julie X Dang
(74) *Attorney, Agent, or Firm* — Arent Fox LLP

(57) ABSTRACT

A piezoelectric sounding component includes a diaphragm that includes a metal plate and a piezoelectric body formed on the metal plate. A casing includes a bottom wall and side walls defining an open sound chamber. The casing also includes a supporting portion on which the diaphragm is supported to cover the open end of the chamber. A terminal is formed on the casing and serves to apply voltage to the diaphragm. An elastic adhesive fixes the diaphragm to the supporting portion and a conductive adhesive is formed on the elastic adhesive and electrically connects the terminal and the diaphragm. An elastic sealing material forms a frame-like sealing portion that seals a gap between outer peripheral edges of the diaphragm and an inner surfaces of the casing. The elastic sealing material also used to cover at least part of an exposed surface of the piezoelectric body to form a protective portion that protects the surface of the
(Continued)

piezoelectric body. The protective portion contacts the sealing portion.

6 Claims, 6 Drawing Sheets

(51) Int. Cl.

| | |
|---|---|
| ***H04R 1/02*** | (2006.01) |
| ***H04R 7/04*** | (2006.01) |
| ***G10K 9/122*** | (2006.01) |
| ***B06B 1/06*** | (2006.01) |
| ***G10K 9/22*** | (2006.01) |
| ***H04R 1/28*** | (2006.01) |

(52) U.S. Cl.
CPC ..... *H04R 1/025* (2013.01); *H04R 7/04* (2013.01); *H04R 31/00* (2013.01); *H04R 1/2811* (2013.01)

(58) Field of Classification Search
USPC ..... 310/322, 331; 382/135
See application file for complete search history.

(56) References Cited

U.S. PATENT DOCUMENTS

| | | | | |
|---|---|---|---|---|
| 6,587,567 | B1 * | 7/2003 | Yamamoto | H04R 1/06 381/190 |
| 6,888,947 | B2 * | 5/2005 | Takeshima | H04R 17/00 310/348 |
| 7,141,919 | B1 * | 11/2006 | Hamada | H04R 17/00 310/348 |
| 7,531,946 | B2 | 5/2009 | Yamauchi et al. | |
| 8,503,700 | B2 | 8/2013 | Fujise et al. | |
| 2001/0004180 | A1 * | 6/2001 | Kishimoto | H04R 1/06 310/324 |
| 2003/0021458 | A1 * | 1/2003 | Hamada | B06B 1/0603 382/135 |
| 2004/0041497 | A1 | 3/2004 | Hamada et al. | |
| 2004/0124748 | A1 * | 7/2004 | Takeshima | H04R 17/00 310/331 |
| 2004/0195941 | A1 * | 10/2004 | Ishimasa | G10K 9/122 310/348 |
| 2007/0228893 | A1 | 10/2007 | Yamauchi et al. | |
| 2009/0015108 | A1 * | 1/2009 | Ishimasa | H04R 17/00 310/353 |
| 2017/0132998 | A1 | 5/2017 | Yamauchi | |

FOREIGN PATENT DOCUMENTS

| | | | |
|---|---|---|---|
| WO | 2011105046 | A1 | 9/2011 |
| WO | 2016067707 | A1 | 5/2016 |

OTHER PUBLICATIONS

Written Opinion of the International Searching Authority issued for PCT/JP2017/019020, dated Jul. 4, 2017.

* cited by examiner

PIEZOELECTRIC SOUNDING COMPONENT

CROSS REFERENCE TO RELATED APPLICATIONS

The present application is a continuation of International application No. PCT/JP2017/019020, filed May 22, 2017, which claims priority to Japanese Patent Application No. 2016-189737, filed Sep. 28, 2016, the entire contents of each of which are incorporated herein by reference.

BACKGROUND OF THE INVENTION

The present invention relates to piezoelectric sounding components and manufacturing methods thereof.

In conventional electronic equipment, such as cellular phones and household appliances, piezoelectric sounding components that produce warning sounds and operation sounds, such as piezoelectric speakers and piezoelectric sounders, are in wide use.

For example, Japanese Unexamined Patent Application Publication No. 2004-15767 discloses such a piezoelectric sounding component. The piezoelectric sounding component described in the foregoing published application has a structure where a piezoelectric sounding body (diaphragm) constituted of a piezoelectric element, which is ceramic for example, and a metal plate, is accommodated in a casing.

In the foregoing piezoelectric sounding component, a piezoelectric element is coated with a coating agent, such as polyimide-based resin or epoxy-based resin. The metal plate is bonded to the casing with an elastic sealant such as a urethane-based sealant or a silicone-based sealant.

However, when different materials are used for the coating agent and the sealant, films having different moduli of elasticity are formed on a surface of a diaphragm. Consequently, distortion of vibration may occur in a boundary between the coating agent and the sealant in the diaphragm and problems in terms of reliability, such as separation on an interface between the coating agent and the sealant, may occur.

The present invention has been made in view of such circumstances and one of the objects of the invention is to provide a piezoelectric sounding component with a favorable vibration characteristics and reliability.

BRIEF DESCRIPTION OF THE INVENTION

A piezoelectric sounding component in accordance with an aspect of the invention includes a diaphragm comprising a metal plate and a piezoelectric body formed on the metal plate so that an upper surface of the piezoelectric body faces away from the metal plate. The diaphragm vibrates according to application of a voltage to the piezoelectric body. A casing includes a bottom wall and side walls defining an open sound chamber. The casing also includes a supporting portion. The diaphragm is supported by the supporting portion such that the diaphragm closes the sound chamber and outer edges of the diaphragm are spaced from inner surfaces of the casing to form a gap. A terminal is formed on the casing. An elastic adhesive fixes the diaphragm to the supporting portion at a position corresponding to the terminal. A conductive adhesive extends over the elastic adhesive and electrically connects the terminal to the diaphragm in such a manner that when the voltage is applied to the terminal, it will be applied to the piezoelectric body. A sealing portion seals the gap between the outer edges of the diaphragm and the inner surfaces of the casing, the sealing portion being made of a sealing material. A protecting portion made of the sealing material covers at least a portion of the upper surface of the piezoelectric body.

In a preferred embodiment, the protecting portion covers the entire upper surface of the piezoelectric body, the sealing portion and the protecting portions of integral with one another and the sealing material covers an entire upper surface of the surface of the diaphragm.

In accordance with another aspect of the invention, a method of manufacturing a piezoelectric sounding component including preparing a casing that includes a bottom wall and side walls defining an open sound chamber and a supporting portion, a terminal being located on the casing. A diaphragm is placed on the supporting portion such that the diaphragm closes the sound chamber and outer peripheral edges of the diaphragm are spaced from inner surfaces of the casing to form a gap. The diaphragm comprising a metal plate and a piezoelectric body formed on the metal plate so that an upper surface of the piezoelectric body faces away from the metal plate, the diaphragm vibrating according to application of a voltage to the piezoelectric body. An elastic insulating adhesive is coated from a position on the diaphragm to the terminal and over a portion of the gap located between the diaphragm and the terminal. The elastic insulating adhesive is hardened. A conductive adhesive is coated over the elastic insulating adhesive so that it extends from the metal plate to the terminal and electrically connects the terminal to the piezoelectric body. The conductive adhesive is hardened. An elastic adhesive is coated over the gap and on at least a portion of the upper surface of the piezoelectric body such that the elastic adhesive extends from the gap to the upper surface of the piezoelectric body. The elastic adhesive is hardened.

The present invention provides a piezoelectric sounding component with favorable vibration characteristics and reliability.

DESCRIPTION OF THE PREFERRED EMBODIMENTS

Figure 1:
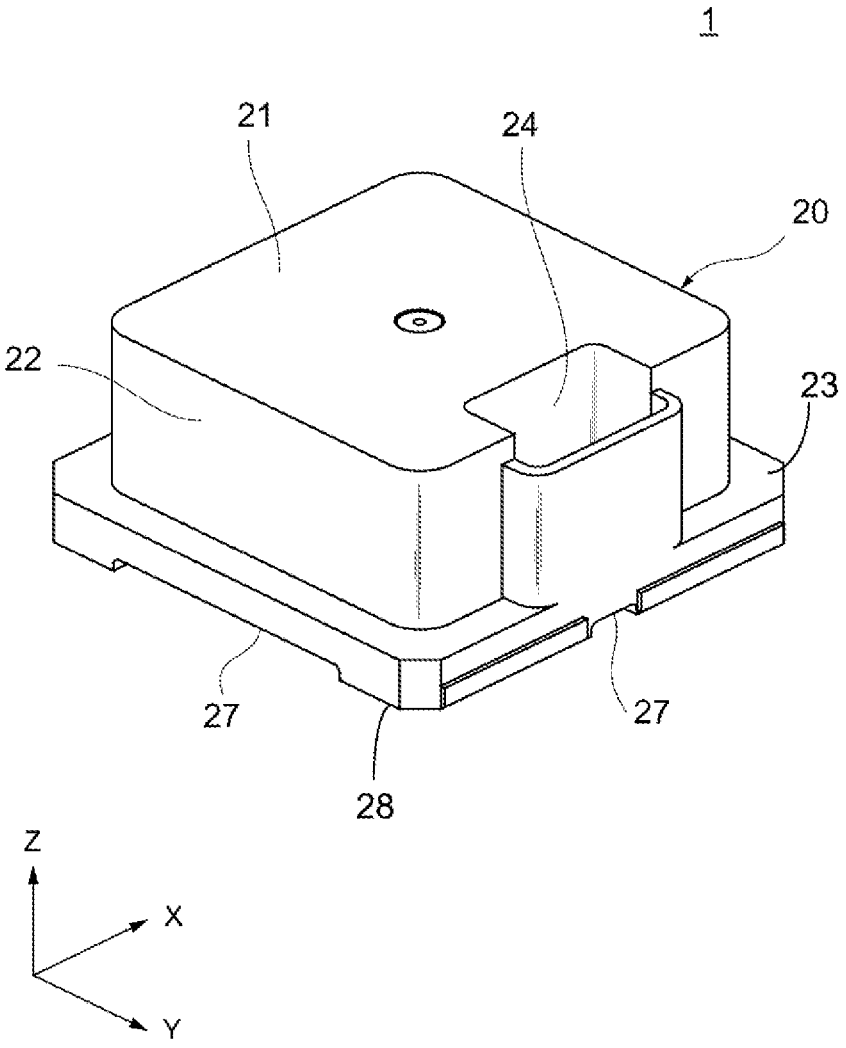
FIG. 1 is a perspective view that schematically illustrates a structure of a piezoelectric sounding component according to an embodiment.
Figure 2:
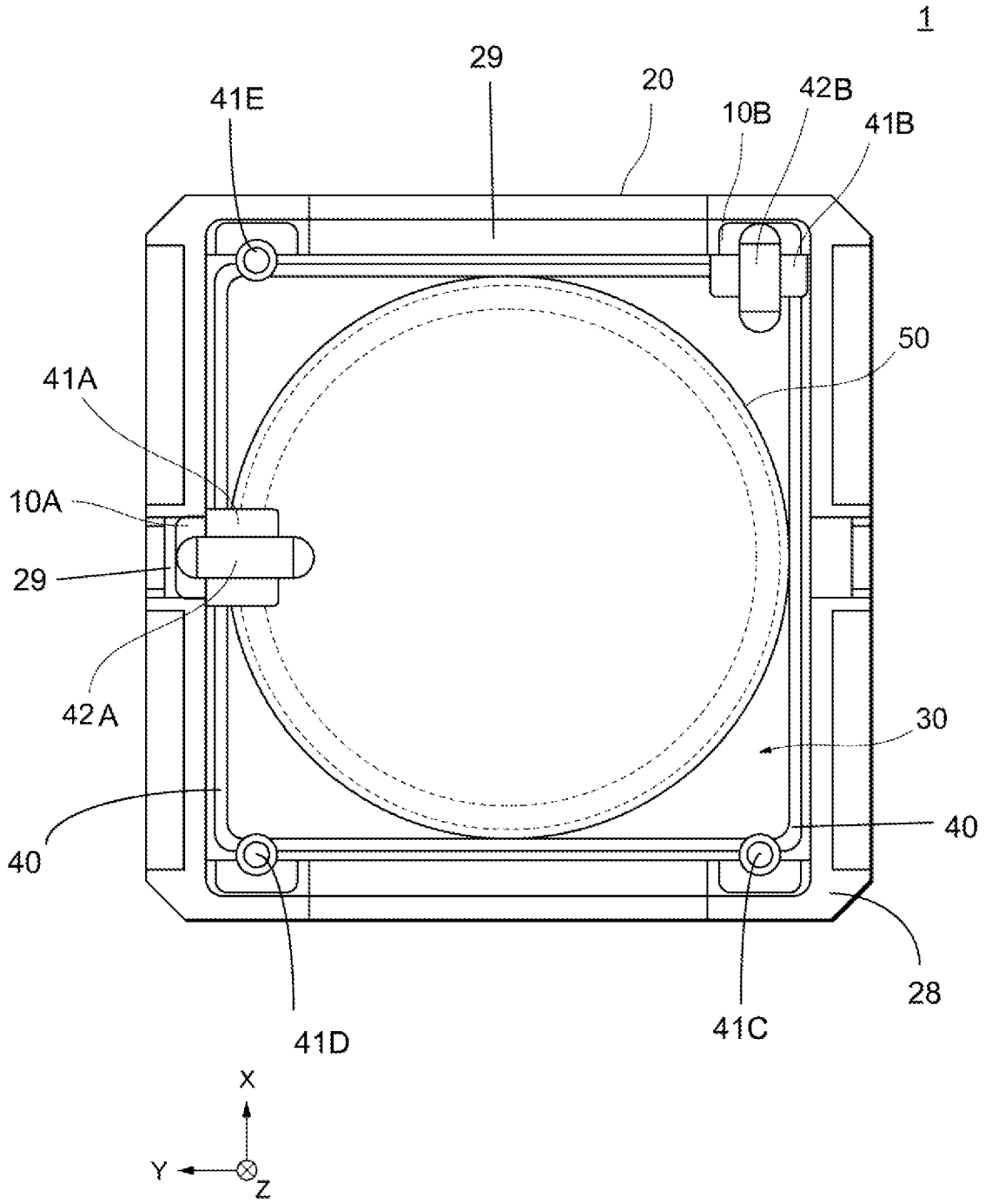
FIG. 2 is a plan view that schematically illustrates a structure of a piezoelectric sounding component according to an embodiment.
Figure 3:
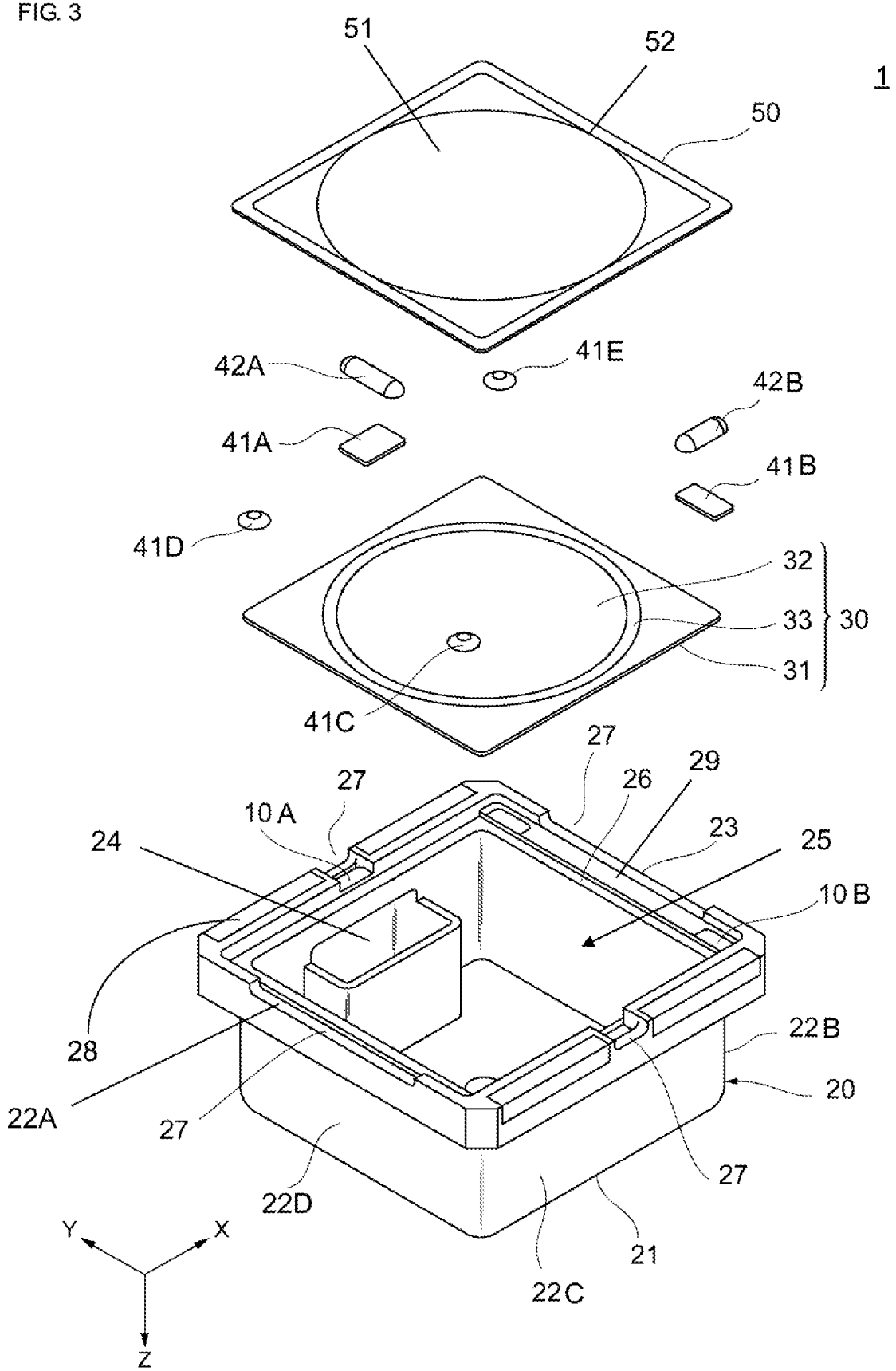
FIG. 3 is an exploded perspective view that schematically illustrates a structure of a piezoelectric sounding component according to an embodiment.

FIG. 1 is a perspective view that schematically illustrates a structure of a piezoelectric sounding component 1 according to a preferred embodiment of the invention. FIG. 2 is a bottom plan view of the piezoelectric sounding component 1 of FIG. 1. FIG. 3 is an exploded perspective view that schematically illustrates a structure of the piezoelectric sounding component 1 (in an orientation that is flipped 180° relative to the orientation of FIG. 1). Although FIGS. 1 to 3 illustrate features and components that are useful in describing at least some of the features of the piezoelectric sounding component 1, other features and/or components can be added and/or one or more of the illustrated features and/or components can be deleted.

(1. Structure)

As illustrated in FIGS. 1 to 3, the piezoelectric sounding component 1 includes a casing 20, a diaphragm 30 and a coating portion 50. The coating portion includes a sealing portion and a protecting portion that are integrally formed of an identical material. The piezoelectric sounding component 1 further includes a plurality of elastic insulating adhesives 41A-41E (cumulatively referred to hereafter as elastic insulting adhesives 41) and a pair of conductive adhesives 42A and 42B (cumulatively referred to hereafter as conductive adhesives 42). The piezoelectric sounding component 1 produces a sound when the diaphragm 30 bends and vibrates as voltage is applied to one or more of the terminals 10 (described further below).

(1-1. Diaphragm)

The diaphragm 30 includes a rectangular flat metal plate 31 and a circular flat plate piezoelectric body 33 formed on the metal plate 31. The metal plate 31 is preferably made from a material that has favorable conductivity and spring elasticity, such as a modulus of elasticity of 1 GPa or more, and specifically, is preferably made from a 42 alloy, stainless steel (SUS), brass, phosphor bronze, or the like. By way of example, the metal plate 31 can be a square flat plate having sides which are 14.6 mm in length and a thickness of approximately 0.08 mm. The metal plate 31 may be formed from a resin-based material, such as a glass epoxy substrate, only when the modulus of elasticity is 1 GPa or more. The metal plate 31 is not limited to a rectangular shape but may have, for example, a circular shape or a polygonal shape.

The piezoelectric body 33 is a circular plate that is preferably made from piezoelectric ceramics, such as PZT, and, for example, has a radius of approximately 13.6 mm and a thickness (in the Z axis direction) of approximately 0.055 mm. The thickness of the piezoelectric body 33 can, for example, be set to approximately 20 μm or more and to a few hundred μm or less according to desired characteristics. The piezoelectric body 33 is not limited to a circular shape but may have, for example, an oval shape or a polygonal shape.

Electrodes 32, which are smaller in diameter than the piezoelectric body 33, are formed on opposite principal surfaces of the piezoelectric body 33. The electrodes 32 may be, for example, an Ag baked electrode with a thickness of approximately 1 μm, a NiCu (nickel-copper) alloy with a thickness of approximately 0.2 to 0.4 or an Ag (silver) sputtering electrode.

The diaphragm 30 is accommodated in the casing 20 so that peripheral edge portions (preferably all of the peripheral edge portions) of the diaphragm 30 are placed on a supporting portion 26 of casing 20. The supporting portion 26 causes the diaphragm 30 to be supported in an XY plane which is parallel to the upper surface of the bottom wall 21. In the present embodiment, the piezoelectric body 33 is formed on only part of the main upper surface (as viewed in FIG. 3) of the metal plate 31, but the invention is not so limited. For example, the piezoelectric body 33 may be formed on the entire upper surface of the metal plate 31.

(1-2. Casing)

The casing 20 includes a bottom wall 21 and four side walls 22A, 22B, 22C and 22D (cumulatively referred to hereinafter as side walls 22) which extend upwardly (as viewed in FIG. 3) at a 90° angle relative to the XY plane of the upper surface of bottom wall 21. The bottom wall 21 and the side walls 20 cooperate which together define a sound chamber 25 whose upper end is closed by the diaphragm 30. A frame 23 extends outwardly and upwardly (as viewed in FIG. 3) from the four side walls 22 and cooperate with the upper surfaces of the side walls 22 to define a supporting portion 26 (the top surface of side walls 22), a ledge 29 and a mounting surface 28. The mounting surface 28 is typically mounted on a mounting substrate such as a circuit board (not shown). The casing 20 is preferably made of an insulative material, such as ceramics or resin. When the casing 20 is formed of resin, it is preferable to use liquid crystal polymer (LCP), syndiotactic polystyrene (SPS), polyphenylene sulfide (PPS), polybutylene terephthalate (PBT), or the like. The casing 20 is not limited to an approximately squared box shape but may, for example, be shaped like a cylinder or a poligonal prism.

A sound releasing hole 24 (FIGS. 1 and 3) is formed in the bottom wall 21 and allows sounds produced through the vibration of the diaphragm 30 to propagate to outside of the casing 20. In the present embodiment, a depression with a thickness of approximately 1 mm is formed around the sound releasing hole 24.

The frame 23 is contiguous with the side walls 22 and extends outwardly and upwardly therefrom (as viewed in FIG. 3). More particularly, the inner surfaces of the frame bends outwardly, in an XY plane, from the upper ends of the side walls 22 to form, inter alia, the ledge 29 and then bend upwardly and terminates in the mounting surface 28. The ledge preferably lies in a plane which is parallel to the XY plane and is coplanar with the upper surface of diaphragm 30 when the piezoelectric sounding component 1 is in its assembled condition. With this structure, the casing 20 supports the diaphragm 30 at a position below (as viewed in FIG. 3) the mounting surface such that a space is formed between the upper surface of the diaphragm 30 and the mounting surface 28. One or more slit-like holes 27 (see FIGS. 1 and 3) are formed in the frame 23 and extend from the space between the upper surface of the diaphragm 30 and the mounting surface 28 and the outside of the casing 20 so as to reduce air resistance in the space.

Because the casing 20 includes the sound releasing hole 24 and the slit-like holes 27, the piezoelectric sounding component 1 can function as a Helmholtz resonator that enhances sound pressure of a specific frequency. The frequency can be adjusted by adjusting the volume of the sound chamber 25, and the dimensions and number of the slit-like holes 27 and the sound releasing hole 24.

By way of example, the outer dimensions of the casing 20 in the present embodiment, can be approximately 18 mm in length along the X axis direction, approximately 18 mm in length along the Y axis direction and approximately 8 mm in thickness along the Z axis direction. The sound releasing hole 24 can have a length of approximately 5 mm along the X axis direction, approximately 3.5 mm along the Y axis direction and approximately 3 mm along the Z axis direction.

(1-3. Terminals)

As best shown in FIG. 3, the terminals 10A and 10B (cumulatively referred to hereinafter as terminals 10) are formed on two adjoining sides of the frame 23. More particularly, terminal 10A is formed on a portion of ledge 29 which is located at the center of wall 22A and terminal 10B is located on a portion of ledge 29 located on the end of side wall 22B which is adjacent side wall 22C. The terminals 10 allow the diaphragm 30 to be electrically coupled to an external circuit. The terminal may be made, for example, by plating with nickel (Ni), copper (Cu), or gold (Au) on iron, brass, or the like. In the present embodiment, the terminal 10 is made of brass (S2680-1/2H), a nickel (Ni) primary coating of 1 μm, and a gold (Au) plating of approximately 0.02 μm or more and 0.1 μm or less. The terminals 10 are not limited to the structure where the terminals 10 are formed on two adjacent sides of the frame 23 and, for example, may be formed on two sides of the frame 23 that face each other or only on one side of the frame.

(2. Adhesion Structure)

The diaphragm 30 supported by the supporting portion 26 is affixed to the casing 20 by elastic insulating adhesives 41A-41E, each of which extend from the diaphragm 30 to the casing 20. Elastic insulating adhesives 41A and 41B are located at positions corresponding to terminals 10A and 10B, respectively. The elastic insulating adhesives 41 are preferably lower in elasticity than the conductive adhesives 42 (described below) and the material thereof is for example, a urethane-based adhesive with a modulus of elasticity that is approximately 3.7 MPa or the like.

As best shown in FIGS. 2 and 3, the conductive adhesives 42A and 42B extend over elastic insulating adhesives 41A and 42B, respectively, from the diaphragm 30 to terminals 10A and 10B, respectively, to electrically connect the diaphragm to the terminals. The conductive adhesives 42A and 42B are preferably formed in the vicinity of the center of its associated elastic insulating adhesive 41A and 41B so as not to stick to the peripheries of its associated elastic insulating adhesive. An example of the material of the conductive adhesives 42 is a urethane-based conductive adhesive with a modulus of elasticity of approximately 0.3 Gpa.

The coating portion 50 is preferably formed of an elastic material and covers both the diaphragm 30 and the gap 40 (FIG. 2) between the outer peripheral edges of the diaphragm 30 and the inner surfaces of the casing 20. [In the preferred embodiment, the coating portion 50 covers the entire exposed upper surface (as viewed in FIG. 3) of the diaphragm.] In this way, the coating portion 50 operates as both a protection portion 51 for protecting the diaphragm 30 (and most importantly the piezoelectric body 33) and a sealing portion 52 which seals the gap 40 between the outer peripheral edges of the diaphragm 30 and the inner surfaces of the casing 20.

Covering the diaphragm 30 with the coating portion 50 enables the piezoelectric body 33 to be protected even in a structure where the piezoelectric sounding component 1 includes no lid on the mounting surface side. Accordingly, the number of sub-components that constitute the piezoelectric sounding component 1 can be reduced.

Although the coating portion 50 preferably covers the entire upper surface (as viewed in FIGS. 2 and 3) of the diaphragm 30 this is not necessary as long as the coating portion 50 covers at least the piezoelectric body 33. In this case, the protecting portion 51 of the coating portion 50 preferably has a shape similar to that of the piezoelectric body 33. For instance, in the example of FIG. 3, the protecting portion 51 has a shape of a circular plate and is in contact with (and is preferably integral with) the sealing portion 52. Further, as in the embodiment of FIGS. 1-3, the protecting portion 51 may have a structure where all of the edge portions thereof are in contact with the sealing portion 52.

The coating portion 50 preferably has a thickness of 500 μm or less to reduce inhibition on the vibration of the diaphragm 30. The coating portion 50 may be made, for example, of silicone, epoxy low in elasticity, fluororesin, or the like. When silicone is used for the coating portion 50, the percentage of content of low molecular siloxane is preferably 100 ppm or less. Thus, an insulation fault of ambient electronic components caused by the siloxane separating from the silicone can be inhibited.

Figure 4:
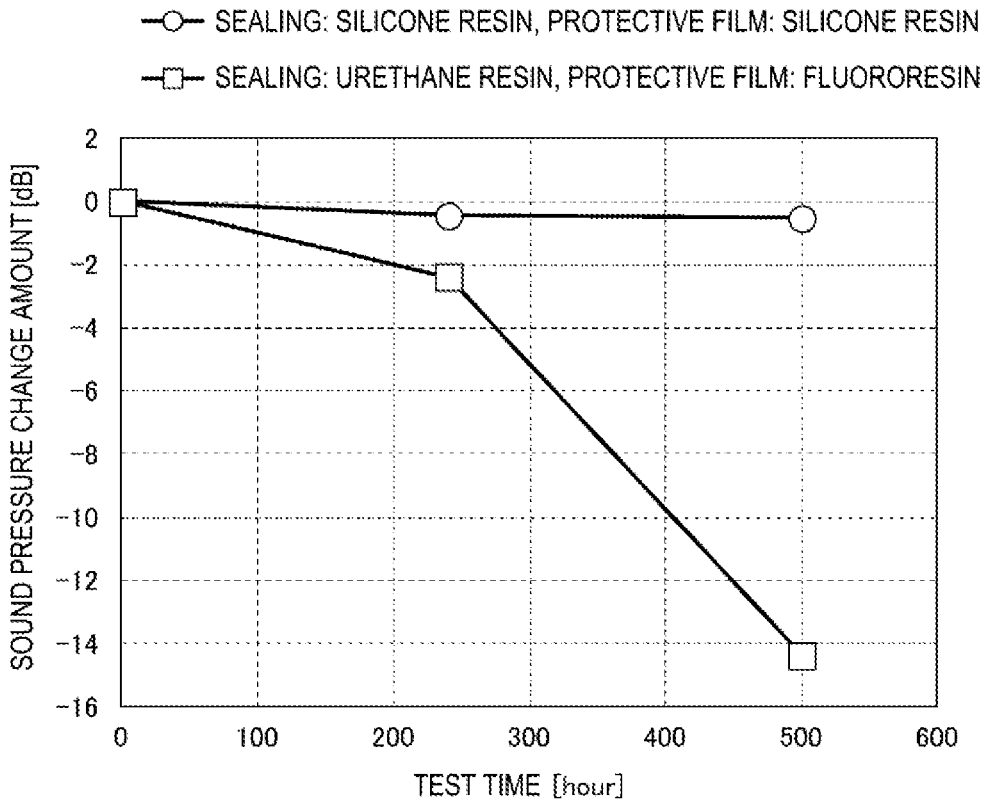
FIG. 4 indicates results of verifying effect of the piezoelectric sounding component according to an embodiment.

FIG. 4 is a graph that indicates results of verifying influence exerted on a sound pressure change amount by integrally forming a sealant and a coating material that are identical. In FIG. 4, the horizontal axis indicates test time and the vertical axis indicates an amount of change in sound pressure. The graph line where the measurement points are depicted as circles indicates the verification results on the piezoelectric sounding component 1 according to the present preferred embodiment where the protecting and sealing portions 51 and 52 are integrally formed of the same material. The graph line where the measurement points are depicted as rectangles indicates the verification results on a conventional piezoelectric sounding component where the protecting and sealing portions are formed of different materials. As demonstrated in FIG. 4, while the sound pressure change amount of the piezoelectric sounding component according to the comparative example increases over time, the sound pressure of the piezoelectric sounding component 1 according to the present embodiment remains almost unchanged over time.

Thus, in the piezoelectric sounding component 1 according to the present embodiment, by sealing the casing 20 and the diaphragm 30 and integrally coating the diaphragm 30 using an identical material, occurrence of distortion in the vibration of the diaphragm 30 can be inhibited and favorable vibration characteristics can be obtained. In addition, by integrally forming the protecting and sealing portions 51 and 52 using the same material, a problem, such as separation on an interface therebetween, can be avoided and change in sound pressure caused by long-time use can be inhibited.

(3. Manufacturing Process)

One example of a process for manufacturing the piezoelectric sounding component 1 will now be described with reference to FIGS. 5(A)-5(D).

Figure 5:
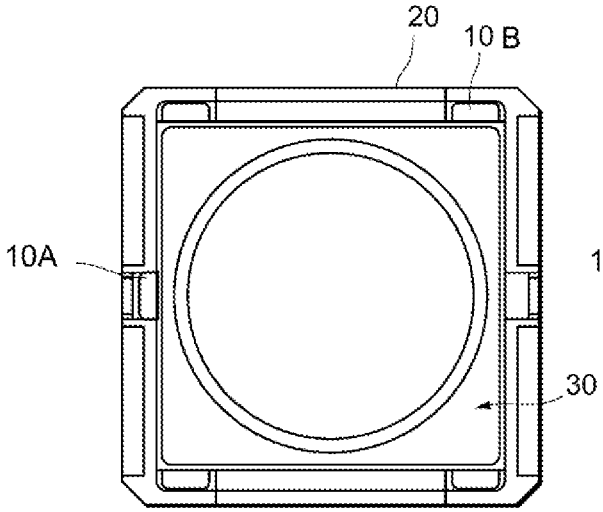
FIGS. 5A-5D illustrate processes of a manufacturing method of a piezoelectric sounding component according to an embodiment.
Figure 5:
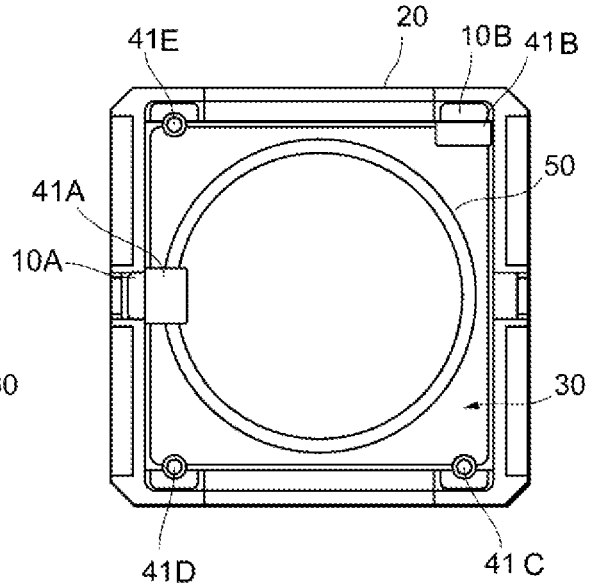
Figure 5:
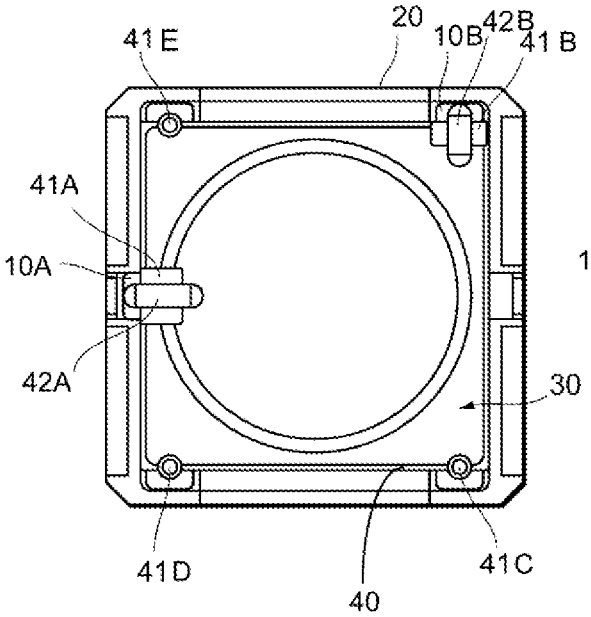
Figure 5:
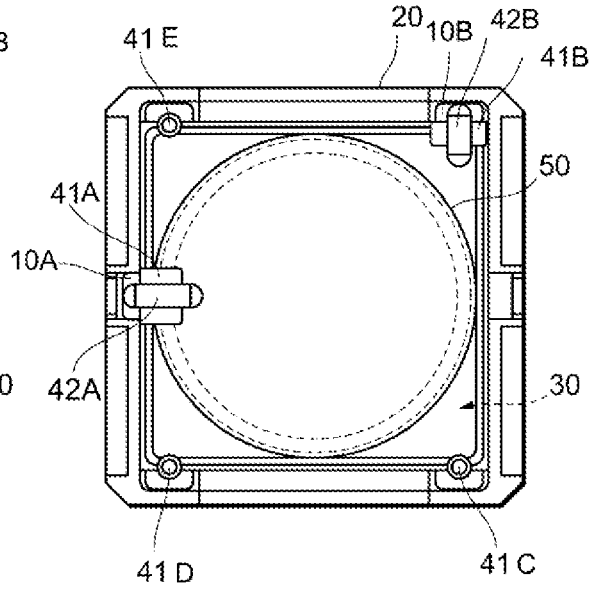

First, the diaphragm 30 is accommodated in the casing 20 so that the metal plate 31 faces the bottom wall 21, and the edges of the diaphragm 30 are supported by the supporting portion 26 (FIG. 5(A)). Subsequently, as illustrated in FIG. 5(B), the diaphragm 30 is fixed to the casing 20 by coating insulating adhesives 41.

After hardening the elastic insulating adhesives 41 by heating or the like, the conductive adhesives 42 are coated so as to lie across the elastic insulating adhesives 41 and are hardened by heating or the like (FIG. 5(C)). Subsequently, an elastic material is coated along the gap 40 between the outside peripheral edges of the diaphragm 30 and the inside edges of the casing 20 to act as a sealant. A similar elastic material is coated over all or some of the upper surface of the diaphragm 30 so as to be in contact with the elastic material coated in the gap 40. The coating portion 50 is formed by hardening the elastic material by heating or the like (FIG. 5(D)). The order in which the elastic material is coated on the diaphragm 30 and the gap 40 is not limited to the foregoing example. For example, after being coated over part of the gap 40, the elastic material may be coated on part of the diaphragm 30 and then coated again on another part of the gap 40.

Figure 6:
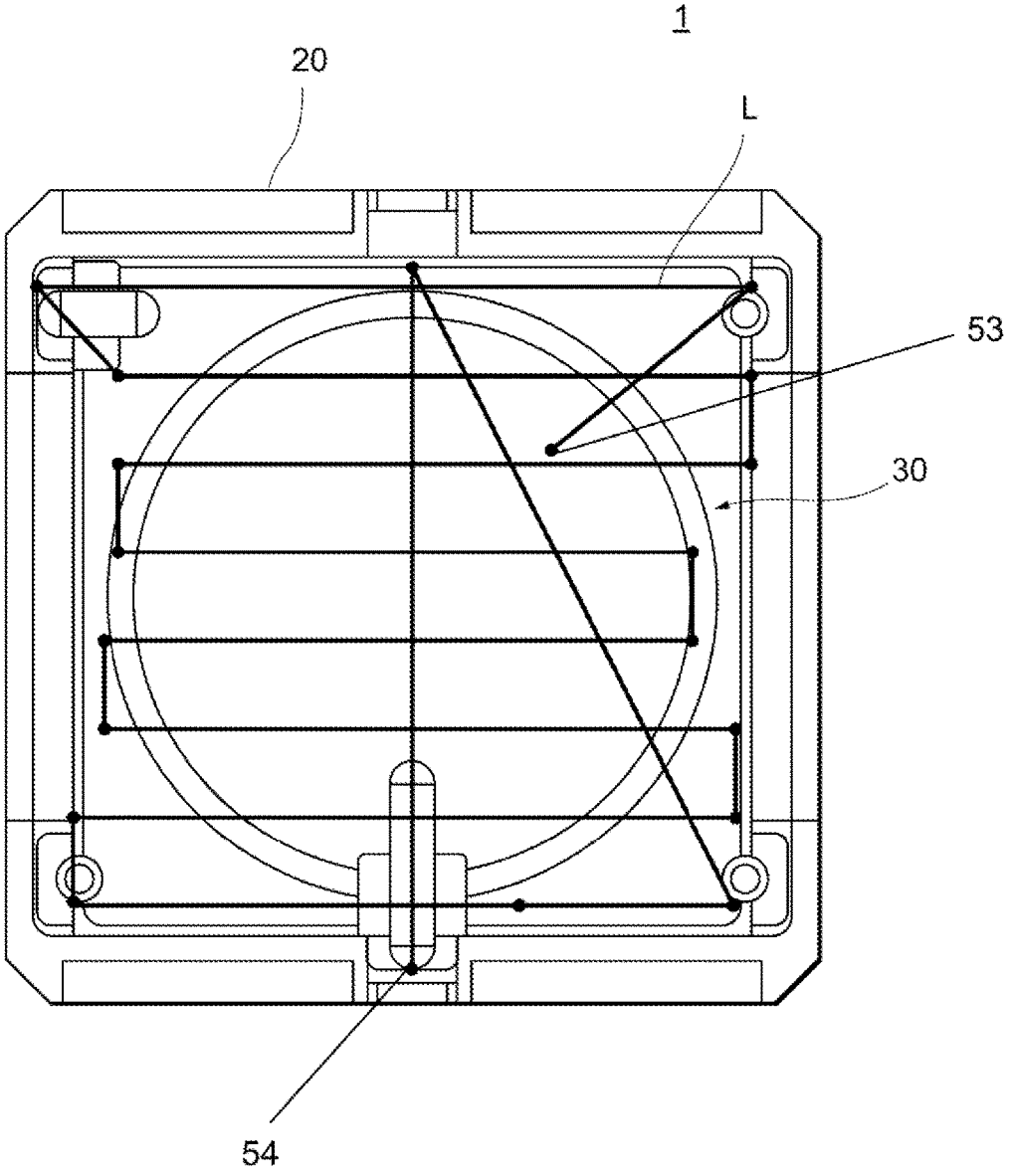
FIG. 6 illustrates an example of a coating method of a coating portion in a piezoelectric sounding component according to an embodiment.

FIG. 6 schematically illustrates a preferred method of coating the coating portion 50 on the upper surface of the diaphragm 30. The solid line in FIG. 6 represents a path of a nozzle used to apply the elastic material used to form the coating portion 50. In the coating method illustrated in FIG.

6, the nozzle starts applying the elastic material at point 53 and then continuously applies the elastic material over the path shown until the nozzle reaches the point 54. In this way, the elastic material can be applied to the entire upper surface of the diaphragm 30 and over the gap 40 in a short period of time.

Thus, in the piezoelectric sounding component 1 according to the present embodiment, the coating portion 50 doubles as a sealing portion 52 covering the gap 40 between the diaphragm 30 and the casing 20 and a protecting portion 51 which protects the diaphragm 30. Thus, a process of hardening by heating or the like can be cut.

In accordance with the foregoing embodiments, a piezoelectric sounding component 1 includes a diaphragm 30 that includes a metal plate 31 and a piezoelectric body 33 formed on the metal plate 31, and bends and vibrates according to application of voltage to the piezoelectric body 33; a casing 20 that includes a bottom wall 21, side walls 22, and a supporting portion 26 to support the diaphragm 30 in inside edge portions of the side walls 22, the side walls extending from edges of the bottom wall 21 in a thickness direction; a terminal 10 that is formed on the casing 20 and serves to apply voltage to the diaphragm 30; an elastic insulating adhesive 41 that is formed on the side wall and fixes the diaphragm 30 to the supporting portion 26; a conductive adhesive 42 that is formed on the elastic insulating adhesive 41 and electrically connects the terminal 10 and the diaphragm 30; a frame-like sealing portion 50 that seals a gap between an outside peripheral edge of the diaphragm 30 and an inside edge portion of the side wall 22; and a protecting portion 50 that is made of a material identical to a material of the sealing portion 50, is provided at least partially on a surface of the piezoelectric body 33 so as to be in contact with the sealing portion 50, and protects the surface of the piezoelectric body 33. In the piezoelectric sounding component 1 according to the present embodiment, the sealing portion 50 and the protecting portion 50 are formed of an identical material and thus, occurrence of distortion in the vibration of the diaphragm 30 can be inhibited by the sealing portion 50 and the protecting portion 50, and favorable vibration characteristics can be obtained. In addition, by integrally forming the sealant and the coating material that are identical, a problem, such as separation on an interface therebetween, can be avoided and change in sound pressure caused by long-time use can be inhibited.

It is preferable that the protecting portion 50 is provided so as to cover the entire exposed upper surface (as viewed in FIG. 3) of the piezoelectric body 33. It is also preferable that in the diaphragm 30, the piezoelectric body 33 is formed so as to cover part of the metal plate 31 and the protecting portion 50 is provided so as to cover all of the surface of the diaphragm 30. According to the preferable aspects, occurrence of distortion in the vibration of the diaphragm 30 can be inhibited by the sealing portion 50 and the protecting portion 50 and favorable vibration characteristics can be obtained. In addition, by integrally forming the sealing portion 52 and the protecting portion 51 using an identical material, a problem, such as separation on an interface therebetween, can be avoided and change in sound pressure caused by long-time use can be inhibited.

It is also preferable that the casing 20 includes an opening in a face that faces the bottom wall 21. According to the preferable aspect, by covering the diaphragm 30 with the coating portion 50, the piezoelectric sounding component 1 can protect the piezoelectric body 33 even in a structure where no lid is provided on the side of the mounting substrate. Thus, members that constitute the piezoelectric sounding component 1 may be reduced.

Each of the above-described embodiments is intended to facilitate understanding of the present invention and is not intended to limit interpretation of the present invention. The present invention can be changed or modified without departing from its gist and the present invention includes equivalents thereof. That is, what is obtained by a person skilled in the art adding a design change to each embodiment when necessary is subsumed in the scope of the present invention as long as such a change includes the features of the present invention. For example, the elements in each embodiment and the arrangements, materials, conditions, shapes, sizes, and the like thereof are not limited to those exemplified but may be changed when necessary. Each embodiment is an example and, not to mention, partial replacements or combinations in structures described in different embodiments are possible and subsumed in the scope of the present invention as long as such partial replacements or combinations include the features of the present invention.

The invention claimed is:

1. A piezoelectric sounding component, comprising:

a diaphragm comprising a metal plate and a piezoelectric body formed on the metal plate so that an upper surface of the piezoelectric body faces away from the metal plate, the diaphragm vibrating according to application of a voltage to the piezoelectric body;

a casing that includes a bottom wall and side walls defining an open sound chamber and a supporting portion, the diaphragm being supported by the supporting portion such that the diaphragm closes the sound chamber and outer edges of the diaphragm are spaced from inner surfaces of the casing to form a gap;

a terminal formed on the casing;

an elastic adhesive fixing the diaphragm to the supporting portion at a position corresponding to the terminal;

a conductive adhesive extending over the elastic adhesive and electrically connecting the terminal to the diaphragm in such a manner that when the voltage is applied to the terminal, it will be applied to the to the piezoelectric body;

a planar film formed of a sealing material, the planar film including both (a) a sealing portion which seals the gap between the outer edges of the diaphragm and the inner surfaces of the casing and (b) a protecting portion which covers at least a portion of the upper surface of the piezoelectric body.

2. The piezoelectric sounding component according to claim 1, wherein the protecting portion covers the entire upper surface of the piezoelectric body.

3. The piezoelectric sounding component according to claim 2, wherein the sealing portion and the protecting portions of integral with one another.

4. The piezoelectric sounding component according to claim 3, wherein the sealing material covers an entire upper surface of the surface of the diaphragm.

5. The piezoelectric sounding component according to claim 1, wherein the sealing portion and the protecting portions of integral with one another.

6. The piezoelectric sounding component according to claim 1, wherein the sealing material covers an entire upper surface of the surface of the diaphragm.

* * * * *